US005253582A

United States Patent [19]

Orth et al.

[11] Patent Number: 5,253,582

[45] Date of Patent: Oct. 19, 1993

[54] SEALING DEVICE FOR A PRINTING PRESS

[75] Inventors: Kevin W. Orth, Des Plaines; Walter J. Pelczarski, Downers Grove, both of Ill.

[73] Assignee: Rockwell International Corporation, Seal Beach, Calif.

[21] Appl. No.: 762,824

[22] Filed: Sep. 19, 1991

[51] Int. Cl.[5] ..... B41F 31/02

[52] U.S. Cl. ..... 101/366; 101/148; 101/350

[58] Field of Search ..... 101/350, 363, 365, 366, 101/207, 208, 210, 148, 155, 156, 157, 167, 169; 277/74, 72 FM, 135, 227

[56] References Cited

U.S. PATENT DOCUMENTS

| | | | |
|---|---|---|---|
| 3,427,776 | 2/1969 | Lake et al. | 277/227 X |
| 3,635,161 | 1/1972 | Leanna | 101/208 X |
| 3,831,517 | 8/1974 | Wagner | 101/208 |
| 3,887,199 | 6/1975 | Sundqvist | 277/74 |
| 4,165,688 | 8/1979 | Leanna et al. | 101/363 X |
| 4,419,932 | 12/1983 | Cappel | 101/363 |
| 4,581,995 | 4/1986 | Stone | 101/366 |
| 4,590,855 | 5/1986 | Schommer et al. | 101/157 |
| 4,796,528 | 1/1989 | Sarazen | 101/208 |
| 5,119,728 | 6/1992 | Rogge | 101/363 |

*Primary Examiner*—Edgar S. Burr
*Assistant Examiner*—Christopher A. Bennett
*Attorney, Agent, or Firm*—C. B. Patti; V. L. Sewell; H. F. Hamann

[57] ABSTRACT

A sealing device (10) for a printing press (11) having a base (12) defining a chamber (24) for retaining ink, a roller (14) mounted on the base (12) over the chamber (24) with the chamber (24) communicating with the roller (14), and a sealing member (20) having a surface (46) for contacting the roller (14), with the sealing member (20) being constructed from a porous material (49) and having a fluid impervious barrier (56 and 58) extending over at least one side (48 and 50) of the sealing member (20) to prevent passage of ink through the sealing member (20).

18 Claims, 4 Drawing Sheets

SEALING DEVICE FOR A PRINTING PRESS

BACKGROUND OF THE INVENTION

The present invention relates to sealing devices for a printing press.

In the past, printing presses have been provided with chambers for retaining ink with a metering roller being mounted over the chamber such that ink passes through an opening of the chamber onto the roller. Also, one or more doctor blades may be mounted adjacent the chamber such that the doctor blades contact an outer surface of the roller. In the past, the device may have a sealing member constructed from a porous material having an inner surface for contacting the roller. The porous material, such as felt, provides a low friction surface for the roller.

However, it has been found that the porous material acts as a wick, and permits passage of ink through the sealing member over an extended period of time during use on the press. In this case, the press must be stopped, and the chamber must be opened in order to replace the sealing members for the device. It has been found very inconvenient to replace these sealing members periodically since the sealing members must be maintained in the inventory for the press, and their replacement contributes to undesirable down time of the press.

SUMMARY OF THE INVENTION

A principal feature of the present invention is the provision of an improved sealing device for a printing press.

The sealing device of the present invention comprises, a base defining a chamber for retaining ink, a roller mounted on said base over the chamber, with the chamber communicating with the roller, and a sealing member constructed from a porous material and having an inner surface for contacting the roller.

A feature of the present invention is that the sealing member has at least one fluid impervious barrier on a side surface of the sealing member.

Another feature of the invention is that opposed side surfaces of the sealing member may have a pair of opposed fluid impervious barriers.

Yet another feature of the invention is that the sealing member provides a low friction surface for the roller such that the sealing member does not significantly impede rotation of the roller.

Another feature of the invention is that the sealing member is resistant to overheating because it can be made thinner.

A further feature of the invention is that the sealing member prevents wicking and leakage of ink through the sealing member.

Another feature of the invention is that the device may have a pair of opposed sealing members with fluid impervious barriers adjacent opposed ends of the roller.

A further feature of the invention is that the device may have a pair of doctor blades contacting spaced locations on the outer surface of the roller.

Yet another feature of the invention is that the sealing members provide a fluid impervious barrier for the opposed ends of the doctor blades.

Yet another feature of the invention is that the sealing members prevent leakage of ink from the sides of the ink chamber, doctor blades, and roller.

Thus, a feature of the invention is that the sealing members minimize the down time of the press usually required to periodically replace the sealing members in the press.

Yet another feature of the invention is that the two-piece sealing members last for a greater length of time.

Still another feature of the invention is that the sealing members provide a three dimensional seal.

Further features will become more fully apparent in the following description of the embodiments of this invention, and from the appended claims.

DESCRIPTION OF THE PREFERRED EMBODIMENTS

Figure 1:
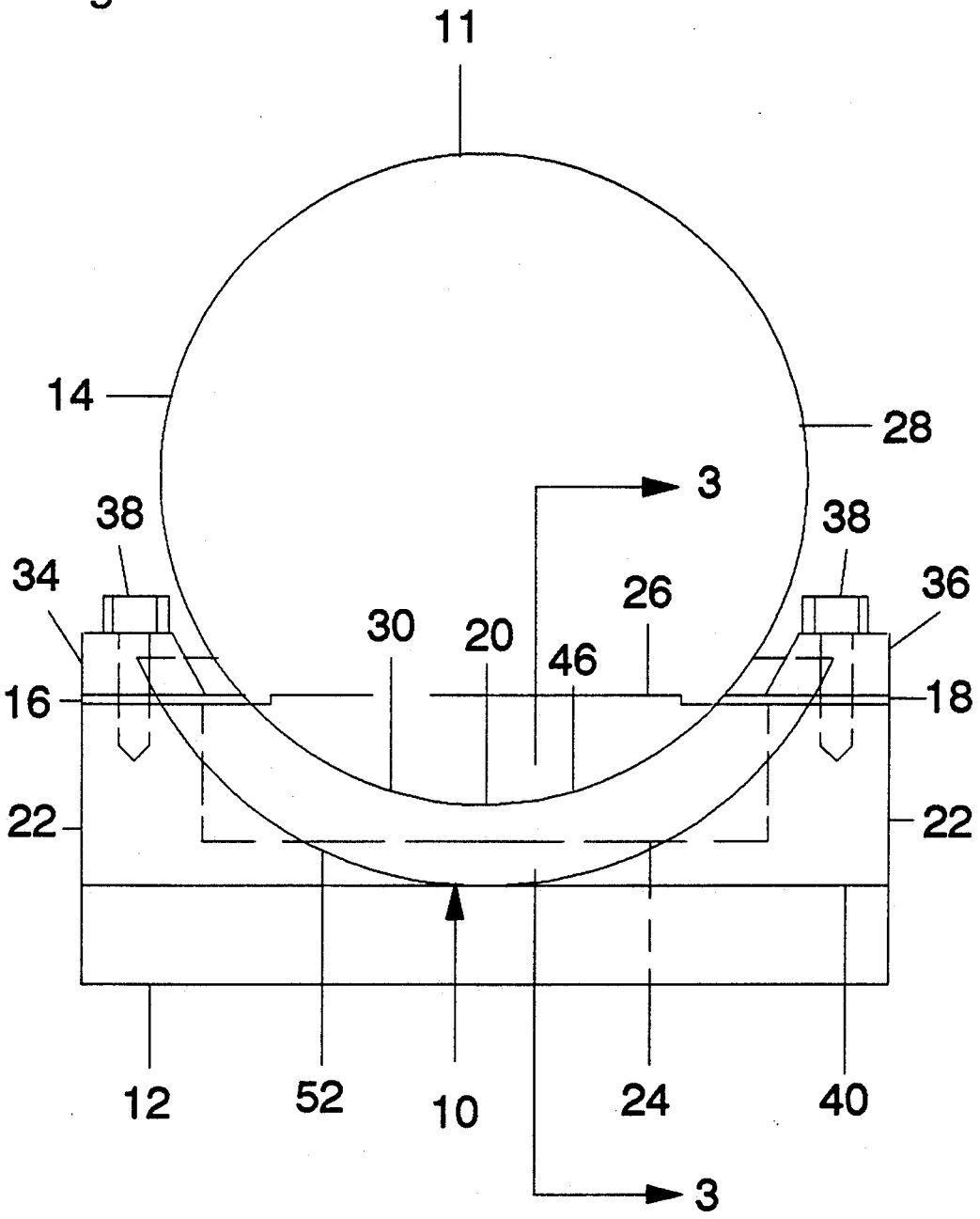
FIG. 1 is an end elevational view of a sealing device for a printing press of the present invention.
Figure 2:
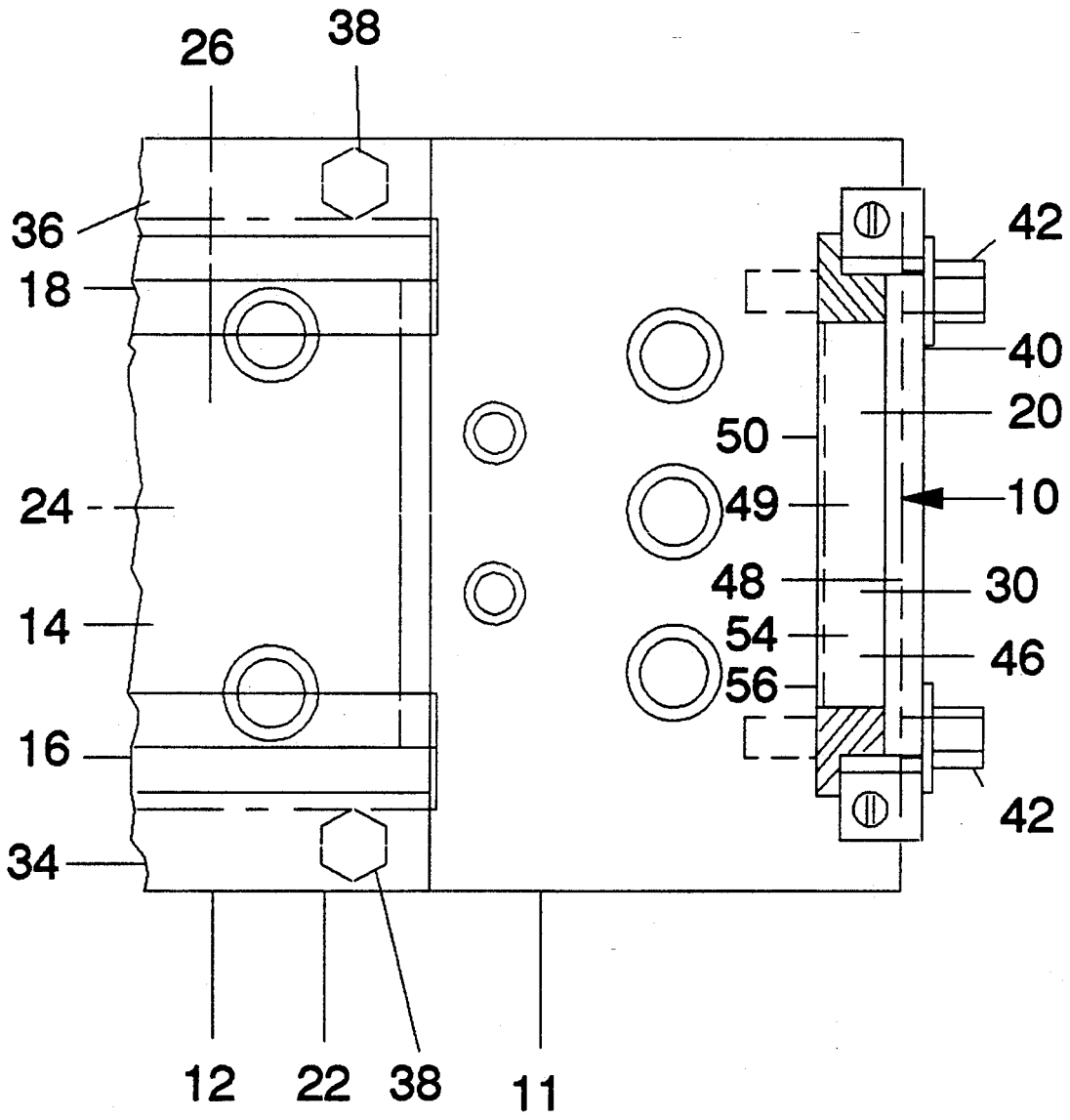
FIG. 2 is a fragmentary top plan view of the sealing device of FIG. 1.
Figure 3:
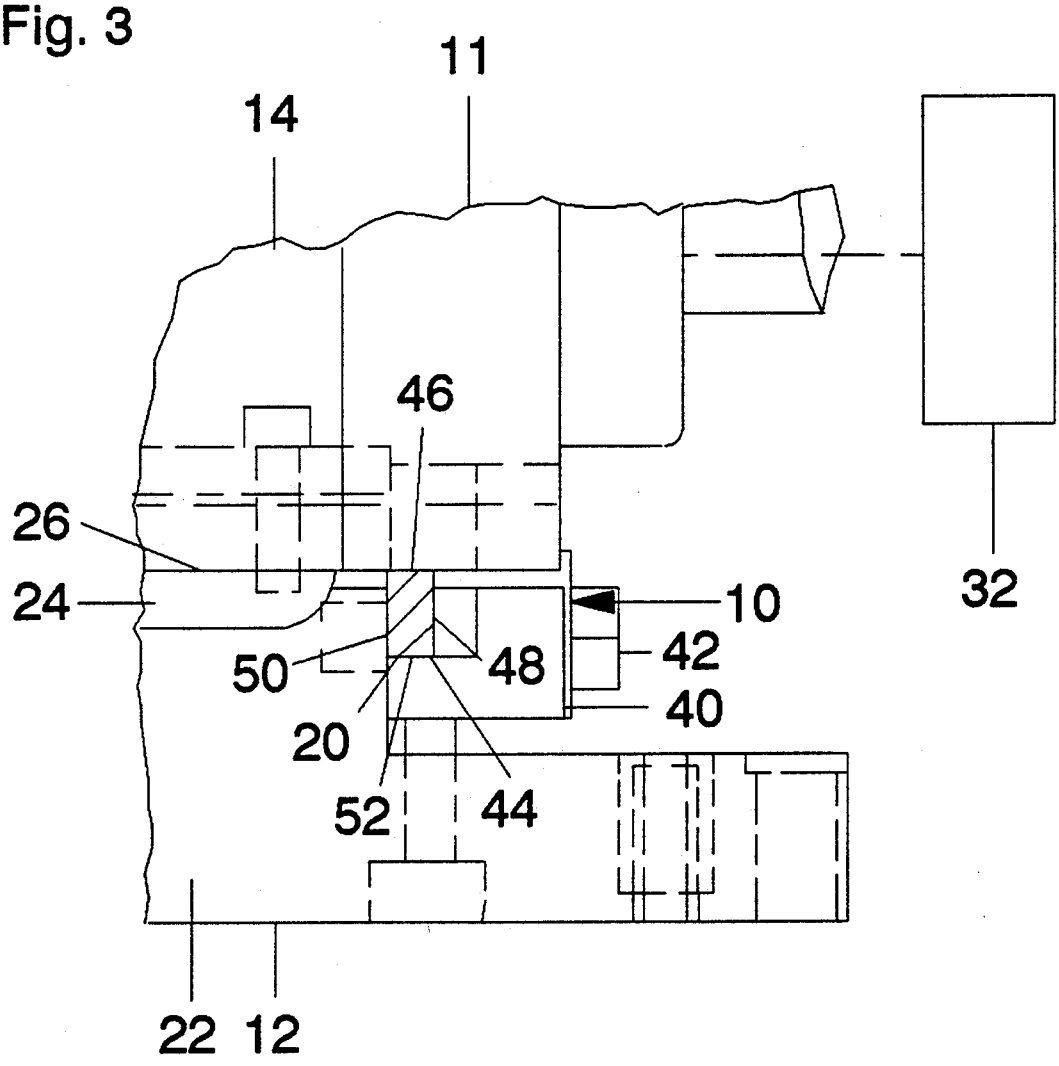
FIG. 3 is a fragmentary sectional view of the sealing device taken substantially as indicated along the line 3—3 of FIG. 1.
Figure 4:
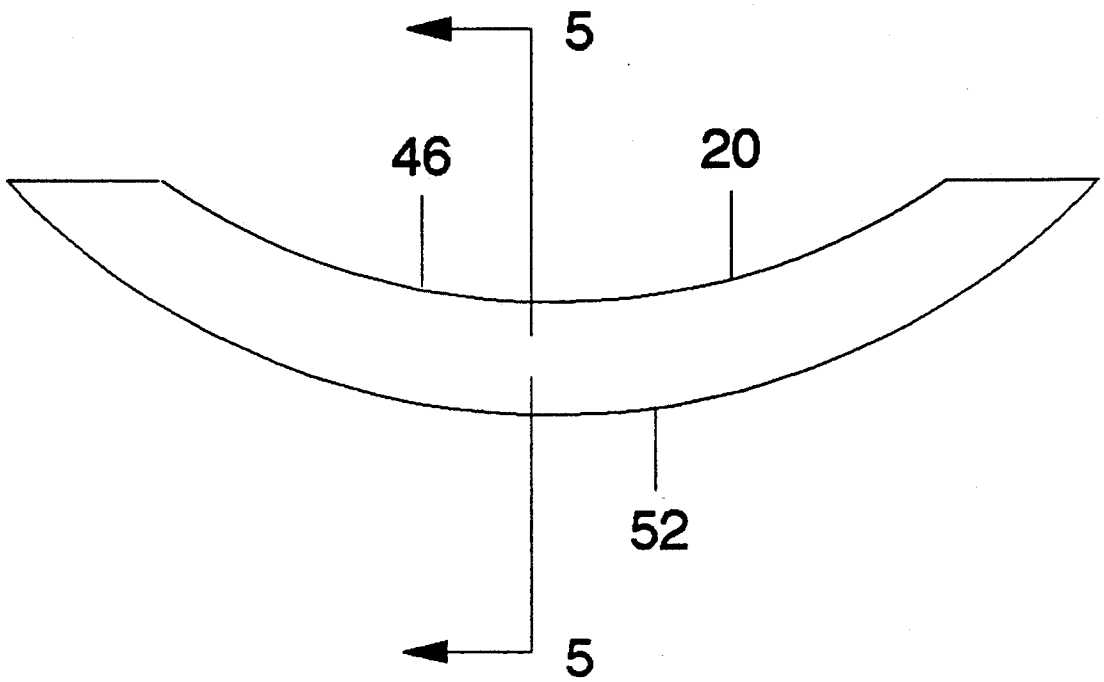
FIG. 4 is an elevational view of a sealing member for the sealing device of FIG. 1.
Figure 5:
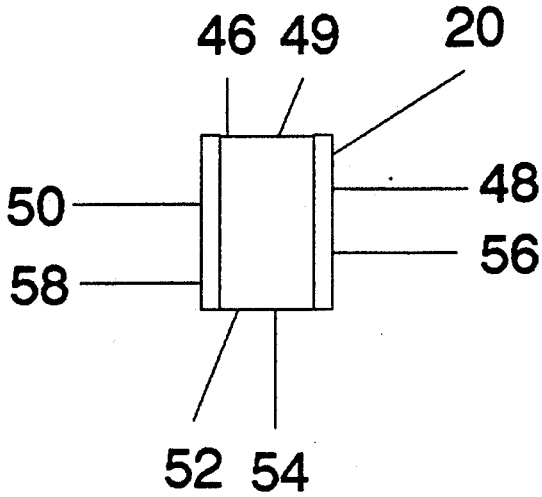
FIG. 5 is a sectional view taken substantially as indicated along the line 5—5 of FIG. 4.

Referring now to FIGS. 1-3, there is shown a sealing device generally designated 10 for a printing press 11 having a base 12, a cylindrical roller 14, such as a metering roller, rotatably mounted on the base 12, a pair of opposed doctor blades 16 and 18 contacting the roller 14, and a sealing member 20 contacting the roller 14. The base 12 has a plurality of sidewalls 22 defining a chamber 24 in the base 12, with the base 12 having an opening 26 facing the roller 14 with the chamber 24 communicating with the roller 14 for passage of ink from the chamber 24 through the opening 26 onto an outer surface 28 of the roller 14.

As shown, the doctor blades 16 and 18 extend along opposed sides of the chamber 24 in the base 12, with the doctor blades 16 and 18 extending longitudinally along the roller 14. During use, one of the doctor blades scrapes excessive ink from the outer surface 28 of the roller 14, while the other doctor blade provides a sealing member along the outer surface 28 of the roller 14, depending upon the direction of rotation of the roller 14. The base 12 has a pair of arcuate recesses 30 adjacent opposed ends of the roller 14 to rotatably receive the roller 14 with the doctor blades preventing the escape of excessive ink from the chamber 24 irrespective of the direction in which the base 12 is placed with respect to the roller 14. The device 10 may have a suitable motor 32, if desired, in order to rotate the roller 14 in either direction, or the roller 14 may be rotated in either direction by other rollers contacting the roller 14.

As shown, the doctor blades 16 and 18 may be mounted on the base 12 by a pair of clamps 34 and 36 which are mounted on the base 12 by a plurality of screws or bolts 38 with the clamps 34 and 36 being located over the doctor blades 16 and 18, respectively.

The device 10 has a pair of end blocks 40 secured to opposed ends of the base 12 by a pair of screws or bolts 42 passing through the blocks 40 into the base 12. In this configuration, the blocks 40 provide an end sealing member for the roller 14, with the roller 14 being rotatably received in the arcuate recesses 30 adjacent opposed ends of the roller 14.

As shown, the blocks 40 have an inner arcuate groove or cut-out 44 to receive the sealing members 20, and position the sealing members 20 in contact with the outer surface 28 of the roller 14 in order to support the roller 14 during its rotation in the press Il, with the roller 14 receiving ink from the chamber 24, and supplying ink from the roller 14 onto other suitable rollers in order to distribute ink in the press 11. During this time, the sealing members 20 provide a low friction surface for contacting the roller 14 such that the sealing members 20 do not significantly impede rotational movement of the roller 14.

The sealing members 20 comprise a central porous material 49, and have an inner arcuate surface 46 for contacting the roller 14, a pair of opposed side surfaces 48 and 50 extending from the inner surface 46, and an outer arcuate surface 52 extending between the side surfaces 48 and 50 of the sealing member 20 with the sealing members 20 being retained in the inner grooves 44 of the blocks 40 through securement bolts 42 of the blocks 40. In this configuration, the sealing members 20 are slightly compressed between the blocks 40 and the base 12.

The sealing members 20 may be constructed from a porous material 49, such as felt. However, it has been discovered that such felt or other porous material acts as a wick for the ink at the ends of the roller 14, and eventually leaks ink through the ends of the device 10, thus requiring replacement.

In accordance with the present invention, the sealing members 20 have a central layer 54 of the porous material, and a pair of opposed fluid impervious strips 56 and 58 bonded to the opposed side surfaces 48 and 50 of the sealing member 20. Thus, the strips 56 and 58 provide a fluid or liquid impervious barrier to the passage of ink through the sealing members 20. In this manner, the sealing members 20 block the passage of ink from opposed ends of the ink chamber 24 in order to eliminate the necessity of replacement of the sealing members 20 during use of the press 11, thus minimizing the down time of the press 11. In addition, the sealing members 20 are placed in abutment with the opposed ends of the doctor blades 16 and 18 in order to seal the ends of the doctor blades 16 and 18, and thus prevent leakage of ink from the opposed ends of the doctor blades, in addition to providing a seal for the opposed ends of the roller 14.

In this manner, the sealing members 20 with opposed liquid impervious barriers prevents leakage from opposed ends of the chamber 24 and opposed ends of the doctor blades 16 and 18. The fluid impervious strips or layers 56 and 58 may be constructed from a suitable liquid impervious plastic material, or may be constructed from a suitable flexible material which is treated with silicone to form a liquid impervious barrier at the opposed sides of the sealing member 20. The strips may be secured to the central porous material 49 or layer 54 by any suitable means, such as by adhesive or heat sealing.

The foregoing detailed description has been given for clearness of understanding only, and no unnecessary limitations should be understood therefrom, as modifications will be obvious to those skilled in the art.

What is claimed is:

1. A sealing device for a printing press, comprising:
a base defining a chamber for retaining ink;
a roller mounted on said base over the chamber, with the chamber communicating with the roller; and
a sealing member having a surface for contacting the roller, said sealing member being constructed from a flexible porous material and having a flexible fluid impervious barrier extending over at least one side of the sealing member to prevent passage of ink through the sealing member, with said contacting surface being free of the fluid impervious barrier, such that the sealing member defines the contacting surface by the porous material facing the roller, with the fluid impervious barrier being of one-piece construction with the porous material, and with the porous material and barrier being flexible to conform to the shape of the roller.

2. The device of claim 1 wherein said chamber opens through one surface of the base towards the roller.

3. The device of claim 1 wherein said roller comprises a metering roller.

4. The device of claim 1 including at least one doctor blade contacting an outer surface of the roller.

5. The device of claim 4 wherein the doctor blade contacts an outer surface of the sealing member adjacent an end of the doctor blade.

6. The device of claim 1 including a pair of spaced doctor blades contacting spaced locations of the roller.

7. The device of claim 6 wherein the doctor blades are located adjacent opposed sides of the ink chamber.

8. The device of claim 1 wherein said sealing member contacts the roller adjacent one end of the roller.

9. The device of claim 8 including a second sealing member contacting the roller adjacent the other end of the roller.

10. The device of claim 1 wherein the porous material comprises felt.

11. The device of claim 1 wherein the sealing member has a pair of opposed side surfaces, and in which the fluid impervious material covers at least one side surface of the porous material.

12. The device of claim 1 wherein the sealing member has a pair of opposed side surfaces, and including a pair of fluid impervious sealing members covering both the side surfaces of the sealing member.

13. The device of claim 1 wherein the porous material comprises felt defining a side surface, and in which the barrier comprises a strip of fluid impervious material secured to at least one surface of the porous material.

14. The device of claim 1 including means for compressing the sealing member.

15. The device of claim 1 wherein said sealing member has a pair of opposed side surfaces, and an inner arcuate surface extending between said side surfaces for contacting an outer surface of the roller.

16. The device of claim 15 wherein said sealing member includes an outer arcuate surface extending between said sides surfaces.

17. A sealing device for a printing press, comprising:
a base defining a chamber for retaining ink;
a rotatably mounted roller mounted on the base over the ink chamber with an outer surface of the roller facing an opening of the ink chamber;
a pair of spaced doctor blades extending along the roller adjacent opposed sides of the ink chamber and contacting spaced locations of the roller along the roller; and
a pair of sealing members constructed from a flexible porous material and mounted on the base adjacent opposed ends of the roller, with the sealing members having an inner arcuate surface contacting the outer surface of the roller, with the sealing members having an inner side surface contacting opposed ends of the doctor blades, said sealing members having an outer side surface facing away from the inner side surface, and a flexible fluid impervious strip secured to the porous material on at least one side surface of the sealing member to prevent leakage of ink through the sealing member while flexing to conform to the shape of the roller, with said inner arcuate surface comprising the porous material only to form a porous surface facing the roller, and with said fluid impervious strip being of one-piece construction with the porous material.

18. The device of claim 17 including a pair of fluid impervious strips covering the inner and outer side surfaces of the porous material in both of said sealing members.

* * * * *